US005168418A

United States Patent [19]

Hurley et al.

[11] Patent Number: 5,168,418

[45] Date of Patent: Dec. 1, 1992

[54] DOUBLE DC COIL TIMING CIRCUIT

[75] Inventors: Rick A. Hurley, Fletcher; Mark E. Innes, Asheville, both of N.C.

[73] Assignee: Westinghouse Electric Corp., Pittsburgh, Pa.

[21] Appl. No.: 688,007

[22] Filed: Apr. 19, 1991

[51] Int. Cl.[5] ..... H01H 47/04; H01H 47/06

[52] U.S. Cl. ..... 361/155; 361/154; 361/210; 361/195

[58] Field of Search ..... 340/644, 686, 687; 361/154, 205, 210, 194, 195-198, 155, 96, 97

[56] References Cited

U.S. PATENT DOCUMENTS

| | | | |
|---|---|---|---|
| 4,065,096 | 12/1977 | Frantz et al. | 251/137 |
| 4,186,420 | 1/1980 | Van Hise | 361/194 |
| 4,479,042 | 10/1984 | Basnett | 200/144 B |
| 4,485,366 | 11/1984 | Basnett | 335/160 |
| 4,504,808 | 3/1985 | Basnett | 335/154 |
| 4,544,817 | 10/1985 | Basnett | 200/293 |
| 4,559,511 | 12/1985 | Basnett et al. | 335/132 |
| 4,642,726 | 2/1987 | Matsko et al. | 361/198 |

OTHER PUBLICATIONS

Westinghouse Bulletin I.L. 16999D; Instructions for V201, V211 V251 320 Ampere Vacuum Contactor Nonreversing or Reversing.

Westinghouse Bulletin I.L. 17232; Instructions for Type SJA 360 Ampere, 7200 Volt Vacuum Contactor.

*Primary Examiner*—A. D. Pellinen
*Assistant Examiner*—Fritz M. Fleming
*Attorney, Agent, or Firm*—M. J. Moran

[57] ABSTRACT

Control circuitry is disclosed for electrical starters, contactors and the like having a starting winding and a serially coupled holding winding wherein the holding winding is shorted until the separable main contacts have closed which includes circuitry which obviates the need for relatively precise sensing of the position of the separable main contacts to control the holding winding. In one embodiment of the invention, the unshorting of the holding winding is delayed a predetermined number of cycles after the separable main contacts have closed to avoid the necessity of relatively accurate mechanical sensing of the position of the separable main contacts. In this embodiment a relatively less expensive field effect transistor or the like is used to short out the holding winding until the separable main contacts have closed. This allows the use of a relatively less expensive limit switch with a substantially smaller DC capability. In alternate embodiments of the invention, control circuits are provided which allow the limit switch normally used for sensing the position of the separable main contacts, to be eliminated altogether, thus further reducing the cost of the device as well as the labor cost involved for adjustment of the limit switch.

1 Claim, 3 Drawing Sheets

DOUBLE DC COIL TIMING CIRCUIT

BACKGROUND OF THE INVENTION

1. Field of the Invention

The present invention relates to control circuitry for electrical devices and, more particularly, to control circuitry for electrical devices, such as contactors, starters and the like having one or more pairs of separable main contacts that are controlled by a dual winding coil having a starting winding and a serially connected holding winding, wherein the holding winding is shorted until the separable main contacts have closed, which includes circuitry which obviates the need for relatively precise sensing of the position of the separable main contacts to control the holding winding.

2. Description of the Prior Art

Various electrical devices are known in the art for controlling electrical equipment, such as motors and the like. These devices include starters, combination starters, contactors and the like for controlling both single phase and multiple phase electrical equipment in reversing as well as non-reversing applications. Such devices include one or more pairs of separable main contacts disposed between such electrical equipment and a source of electrical power. The separable main contacts are generally intended to interrupt the normal rated current of the electrical equipment and limited overcurrent conditions (e.g., up to approximately 10 x rated current) and are not intended to interrupt during a severe overcurrent condition, such as a short circuit condition. Overcurrent protection is generally provided by other devices, such as circuit breakers, fuses, and the like. Such overcurrent devices either can be included with the device or provided externally, depending on the particular application.

In such devices, the separable main contacts are mechanically interlocked with an armature that is controlled by a dual winding coil having a starting winding and a series connected holding winding. A biasing spring or gravity maintains the separable main contacts in a normally open position. The dual coil winding is normally under the control of an electrical interlock, such as an on and off switch, to allow the separable main contacts to be closed on command. Since the biasing force of the spring, which can exceed 100 pounds, must be overcome in order to close the separable main contacts, the holding winding is normally shorted out to allow relatively high electrical current to flow through the starting winding generating a relatively high force via the high ampere turns which causes the separable main contacts to close. However, once the separable main contacts are closed, the force required to maintain that position is significantly less than the force required to initially overcome the spring force. Therefore, the holding winding is unshorted thereby reducing the electrical current to the starting winding.

It is known in the art to use a mechanical interlock, such as a limit switch (often designated as L63) to sense the armature position to determine when the separable main contacts are in a closed position for purposes of shorting and unshorting the holding winding. The limit switch is normally provided with a normally closed contact, connected in parallel across the holding winding. Since the limit switch contact is subjected to the relatively large starting current as well as the inductive kick resulting from the sudden change of electrical current through the windings due to the unshorting of the holding winding, the limit switch must be provided with a relatively heavy duty contact which can be relatively expensive, thus increasing the cost of the device.

Additionally, in known devices the adjustment of the limit switch is fairly critical. More specifically, since the starting winding is only intended to conduct relatively high electric starting currents for a relatively short period of time, the starting winding normally is provided with an intermittent rating to handle the relatively large starting current. Consequently, it is necessary that the limit switch be adjusted relatively precisely to unshort the holding winding to reduce the electrical current through the starting winding relatively quickly after the separable main contacts are closed to avoid overheating. Moreover, improper adjustment of the limit switch can cause misoperation of the device. More specifically, if the holding winding is unshorted prematurely the electrical current through the windings will be significantly reduced (e.g., prior to the closure of the separable main contacts), this will result in chattering of the armature and failure to fully close the separable main contacts. This can result in device failure by either the main contacts welding or the coil burning out.

SUMMARY OF THE INVENTION

It is an object of the present invention to solve the problems associated with the prior art.

It is yet a further object of the present invention to provide a control circuit for electrical contactors, starters and the like which reduces the need for relatively precise adjustment of mechanical switches, such as limit switches and the like, for determining the position of the separable main contacts.

It is yet another object of the present invention to eliminate the need for providing a relatively heavy duty and expensive limit switch for sensing the position of the separable main contacts.

Briefly, the present invention relates to control circuitry for electrical starters, contactors and the like having a starting winding and a serially coupled holding winding wherein the holding winding is shorted until the separable main contacts have closed which includes circuitry which obviates the need for relatively precise sensing of the position of the separable main contacts to control the holding winding. In one embodiment of the invention, the unshorting of the holding winding is delayed a predetermined number of cycles after the separable main contacts have closed to avoid the necessity of relatively accurate mechanical sensing of the position of the separable main contacts. In this embodiment a relatively less expensive field effect transistor or the like is used to short out the holding winding until the separable main contacts have closed. This allows the use of a relatively less expensive limit switch with a substantially smaller DC capability. In alternate embodiments of the invention, control circuits are provided which allow the limit switch, normally used for sensing the position of the separable main contacts, to be eliminated altogether, thus further reducing the cost of the device as well as the labor cost involved for adjustment of the limit switch.

DESCRIPTION OF THE DRAWING

These and other objects and advantages of the present invention will become readily apparent from the following description and the accompanying drawing, wherein.

DETAILED DESCRIPTION OF THE DRAWING

It will be clear to those of ordinary skill in the art that the principles of the present invention are equally applicable to contactors, starters, combination starters and the like, both reversing and non-reversing. Moreover, for illustration purposes, a Westinghouse type SJA vacuum type contactor is described and illustrated. However, it should also be understood that the principles of the present invention are equally applicable to various types of contactors including air contactors.

The present invention relates to control circuitry for electrical devices having separable main contacts that are controlled by a dual winding coil having a starting winding and a holding winding, such as electrical contactors, starters and the like. Examples of such apparatus are described in detail in Westinghouse bulletins I.L. 1699D and I.L. 17232 and U.S. Pat. Nos. 4,479,042; 4,485,366; 4,504,808; 4,544,817 and 4,559,511, assigned to the same assignee as the present invention and hereby incorporated by reference.

Figure 1:
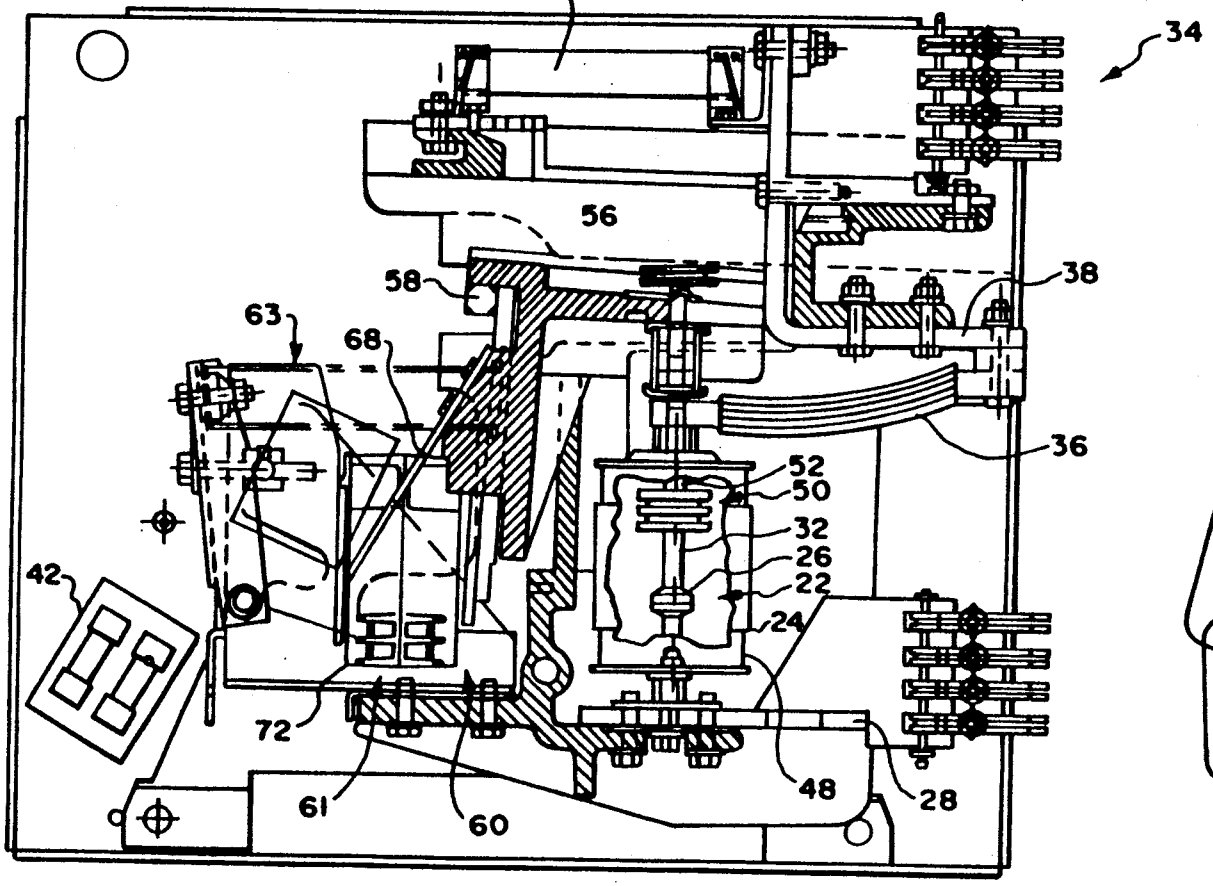
FIG. 1 is a cross-sectional view of an electrical contractor, shown in a closed position, adapted to be used in accordance with the present invention.

Referring to the drawing, and in particular FIG. 1, a vacuum contactor 20 is illustrated. The vacuum contactor 20 includes one or more pairs of separable main contacts 22, which include a stationary contact 24 and a movable contact 26. The stationary contact 24 is rigidly attached to a load side conductor 28. The load side conductor 28 may, in turn, be electrically coupled to a load side terminal, such as load side stabs 30, to allow the load side terminal to be removably connected to a load side bus in a panelboard (not shown).

The movable main contact 26 is connected to a movably mounted line side conductor 32. The line side conductor 32 is electrically coupled to a line side terminal, such as the line side stabs 34 by way of a flexible shunt conductor 36. A rigid line side conductor 38 may be disposed between the flexible conductor 36 and the line side stabs 34. The line side stabs 34 allow the contactor 20 to be removably connected to a line side bus in the panel board.

Since the system voltage of the contactor 20 can be relatively large, for example, 600–7200 volts, a control power transformer 39 (FIG. 3) is generally provided to reduce the control circuit voltage to generally either 120 volts or 240 volts. The control power transformer 39 may be provided with primary fuses 40, connected on one end to the rigid line side conductor 38 and on the other end to the primary winding of the control power transformer 39. Secondary fuses 42 may be provided and connected on one end to the secondary winding of the control power transformer 39 and on the other end to a terminal block 43.

As shown in FIG. 1, a vacuum contactor is illustrated. In such a device, each pair of separable main contacts 22 are disposed in a vacuum bottle 48. The load side conductor 28 is sealed at the vacuum bottle 48 interface to provide a gas tight seal. The line side conductor 32 is movably mounted within the vacuum bottle 48 by way of a bellows 50. The bellows 50 allows the movable main contact 26 to be moved to an open position and a closed position without letting air into the vacuum bottle 48. The bellows 50 is coupled to a conductive shaft 52 which, in turn, is coupled to the shunt 36 as well as an armature assembly 54.

The armature assembly 54 includes a generally L-shaped crossbar 56 pivotally mounted about a shaft 58. The crossbar 56 is under the control of an electromagnet assembly 60 which includes a dual winding coil 61 having a starting winding 62 and a holding winding 64, disposed about a magnetically permeable core forming an electromagnet. When the electromagnet assembly 60 is energized, for example, in response to a control signal, such as a pushbutton switch, the magnetic flux generated thereby exerts an attraction force on the crossbar 56 causing it to rotate in a clockwise direction about the shaft 58. Since the crossbar 56 is rigidly attached to the movable main contact 26, this causes the movable main contact 26 to move toward the closed position. When the electromagnet assembly 60 is deenergized, a kick out spring 63 biases the crossbar 56 in a counterclockwise direction toward an open position.

The crossbar 56 includes a control surface 66. The control surface 66 is adapted to receive operating levers, such as the operating levers 68 and 70. The operating levers 68 and 70 may be used to actuate limit switches, such as the limit switches 72 and 74. More specifically, an operating lever 68 (FIG. 1) is connected to a front side of the control surface 66 to actuate the limit switch 72. The operating lever 70 may be connected on a back side of the control surface 66 (FIG. 2) to actuate the limit switch 74. The limit switch 72 may be provided as an option to provide one or more auxiliary contacts to indicate the status of the separable main contacts 22. The limit switch 74 includes a normally closed contact 75 (FIG. 3), generally used for control of the holding winding 64, as discussed below. However, in such prior art applications as previously mentioned, the adjustment of the limit switch 74 has been rather critical. In addition, since the limit switch contact 75 in prior art applications has been connected to the dual coil winding 61, a relatively heavy duty and expensive limit switch has heretofore been used. The principles of the present invention solve this problem by providing three alternative control circuits illustrated in FIGS. 3–5.

Figure 3:
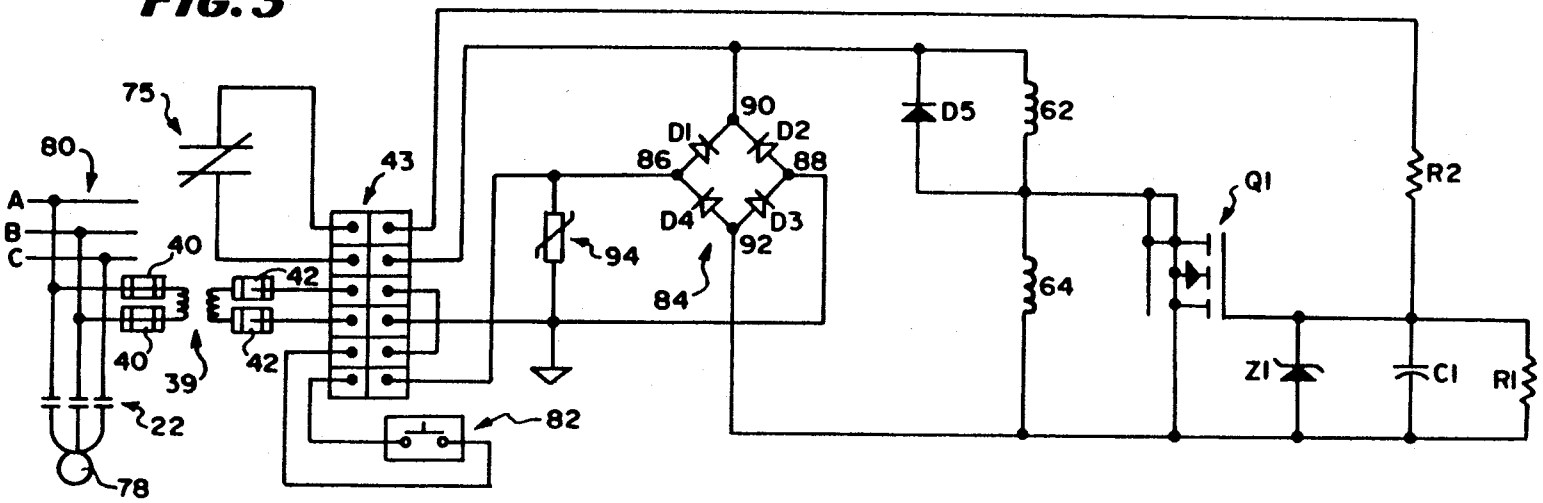
FIG. 3 is a schematic diagram of an electrical control circuit in accordance with the present invention.

More specifically, the control circuit illustrated in FIG. 3 utilizes a limit switch 74 but obviates the need for having a heavy duty limit switch or precise adjustment thereof. The control circuits illustrated in FIGS. 4 and 5 eliminate the need for the limit switch 74 altogether.

Figure 4:
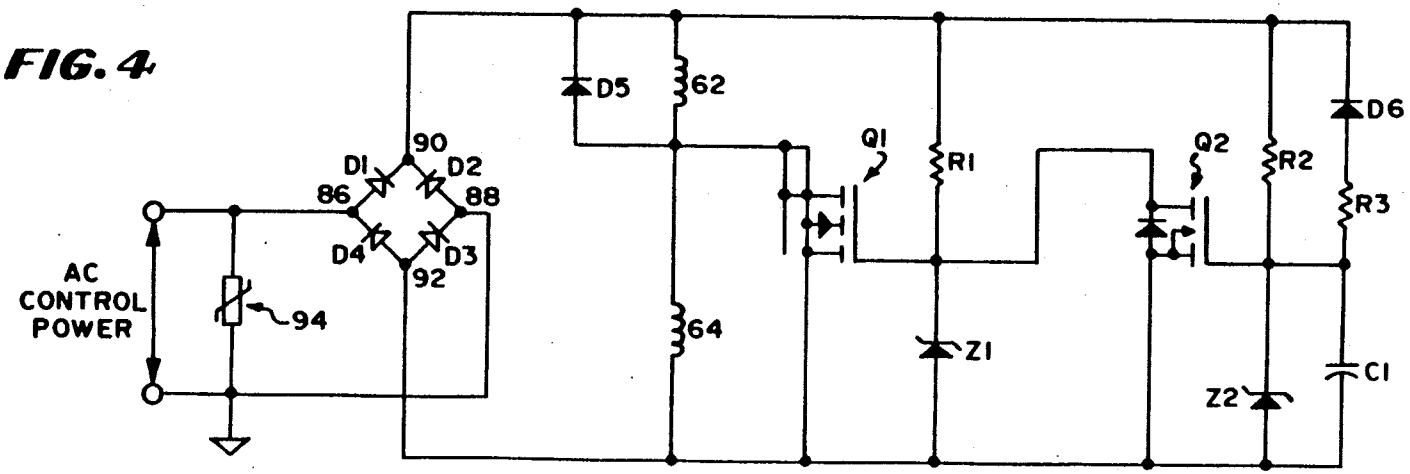
FIG. 4 is a schematic diagram of an alternate electrical control circuit in accordance with the present invention.
Figure 5:
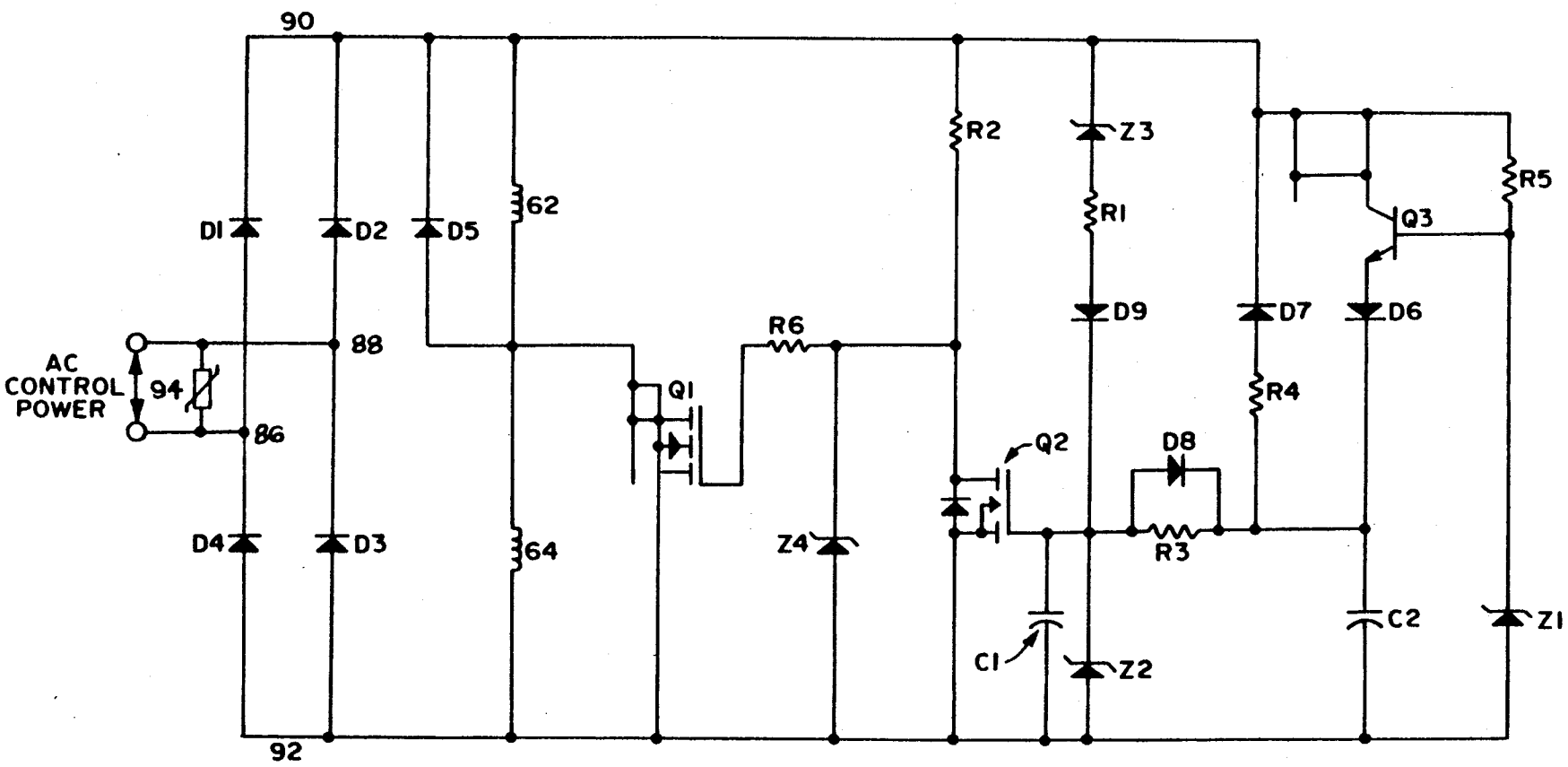
FIG. 5 is a schematic diagram of another alternate embodiment of an electrical control circuit in accordance with the present invention.

FIGS. 3–5 and the accompanying description relate to three phase non-reversing contactors. However, it should be clear to those skilled in the art that the principles of the present invention equally apply to reversing contactors as well as single phase and other multiple phase contactors. It will be further understood that the principles of the present invention also apply to motor starters and combination motor starters as well as contactors.

Referring to FIG. 3, a contactor 20 is shown for connecting electrical equipment, such as a motor 78, to a source of electrical power, generally identified by the reference numeral 80, by way of the separable main contacts 22. Control power for the control circuit is provided by the control power transformer 39.

The control power transformer 39 is normally a step down transformer which steps down the voltage of the electrical power source 80, for example, 7200 volts, down to either 240 volts or 120 volts AC. The primary winding of the control power transformer 39 is normally connected across two phases of the electrical power source 80, for example, the A and B phases, by way of the primary fuses 40. The secondary winding of the control power transformer 39 is normally connected to a terminal block 43 by way of the secondary fuses 42.

In order to enable an operator to control the electrical apparatus 78, an electrical interlock, such as a push-button switch, control switch or the like, identified with the reference numeral 82, is electrically coupled to the control circuit. It should also be understood that the electrical equipment 78 may also be controlled by a process interlock, such as a pressure switch or the like. The electrical interlock 82 may be connected to the terminal block 43 so as to be disposed in series with the secondary winding of the control power transformer 39 as shown in FIG. 3 to allow the contactor 20 to be selectively enabled.

In one embodiment, the contactor control circuit in accordance with the present invention includes a bridge rectifier 84, formed from diodes D1, D2, D3 and D4, connected as shown in FIG. 3. The bridge rectifier 84 defines a pair of AC input terminals 86 and 88 and positive and negative DC output terminals 90 and 92, respectively. AC control power from the secondary winding of the control power transformer 39 is applied to the AC input terminals 86 and 88 whenever the electrical interlock 82 is enabled in order to close the separable main contacts 22 and start the electrical equipment 78. Since the control power is derived from the electrical power source 80, a surge protective device 94, such as a metal oxide varistor, may be connected across the AC input terminals 86 and 88 and grounded to suppress any transient overvoltages in the electrical power source 80.

On power up (e.g., when AC control power is applied to the AC input terminals 86 and 88), DC power from the DC output terminals 90 and 92 is applied across the serially connected starting winding 62 and holding winding 64. A switching device, such as a field effect transistor (FET) Q1 having gate, drain and source terminals, is used to short out the holding winding 64 on power up. More specifically, the drain and source terminals of the transistor Q1 are connected in parallel across the holding winding 64. The gate terminal of the transistor Q1 is under the control of the normally closed limit switch contact 75, a charging resistor R2, a Zener diode Z1 and a time delay circuit. More specifically, the series combination of the charging resistor R2 and the limit switch contact 75 is connected between the positive DC terminal 90 and the gate terminal of the transistor Q1. A Zener diode Z1 is connected between the negative DC terminal 84 and the gate terminal of the transistor Q1. A time delay circuit consisting of a parallel connected resistor R1 and a capacitor C1 is connected between the negative DC terminal 92 and the gate terminal of the transistor Q1 as shown in FIG. 3.

On power up, the normal DC voltage across the series combination of the resistor R2 and the Zener diode Z1 forces the Zener diode Z1 into conduction which, in turn, turns on the transistor Q1. Since the drain and source terminals of the transistor Q1 are connected in parallel with the holding winding 64, this causes the holding winding 64 to be shorted out allowing the full starting current to flow through the starting winding 62. At the same time, the capacitor C1 is being charged by way of the charging resistor R2. Once the limit switch contact 75 opens, indicating that the separable main contacts 22 have closed, control power is effectively disconnected from the control circuit. However, the voltage across the capacitor C1 maintains the voltage on the gate terminal of the transistor Q1 for a predetermined time period after the limit switch contact 75 opens, determined by the time constant of the capacitor C1 and a parallel connected discharge resistor R1. Once the time constant times out, the voltage across the capacitor C1 is discharged through the resistor R1 resulting in the transistor Q1 switching off and unshorting the holding winding 64 which, in turn, substantially reduces the electrical current through the starting winding 62.

As previously mentioned, when the limit switch contact 75 opens, control power is disconnected from the circuit. This causes a flyback diode D5, connected in parallel across the starting winding 62, to become forward biased to provide a recirculation path for the coil current to reduce the inductive kick of the starting winding 62 as a result of the sudden reduction in electrical current therethrough when the holding winding 64 is unshorted.

In the above-described circuit, the adjustment of the limit switch 74 is not critical since the unshorting of the holding winding 64 is delayed for a predetermined time period after the main contacts 22 close. This time period is governed by the time constant of the resistor R2 and the capacitor C1. Moreover, since the limit switch contact 75 is not connected to the windings 62 and 64 as in prior art devices, the limit switch contact 75 will not be subject to the inductive kick resulting from the sudden reduction in electrical current to the starting winding 62 when the holding winding 64 is unshorted. Accordingly, a relatively less expensive limit switch 74 can be used.

In the control circuits illustrated in FIGS. 4 and 5, the limit switch 74 is eliminated altogether further reducing the cost of the device. In these circuits, the control power transformer 39 and the electrical interlock 82 are connected in the same manner as illustrated and described in FIG. 3 and thus will not be repeated for brevity. Moreover, like components in the alternate embodiments will be identified with the same reference numerals as in FIG. 3.

Referring to FIG. 4, the control circuit in accordance with the present invention includes a bridge rectifier 84, formed from the diodes D1, D2, D3 and D4 which define AC input terminals 86 and 88 and DC output terminals 90 and 92. A surge protector device 94 may be connected across the AC input terminals 86 and 88 and grounded to protect the circuit from power surges from the electrical power source 80.

The control circuit also includes a starting winding 62 complete with the flyback diode D5, a holding winding 64, as well as transistors Q1, Q2, resistors R1, R2 and R3, Zener diodes Z1 and Z2, a capacitor C1 and a diode D6. The serial combination of the starting winding 62 and the holding winding 64 is connected to the DC output terminals 90 and 92. The flyback diode D5 is connected in parallel across the starting winding 62.

The transistor Q1 is used to initially short the holding winding 64. More specifically, the transistor Q1 includes a gate, source and drain terminals. The drain and source terminals are connected in parallel across the holding winding 64. The gate terminal is connected at the junction of the serial combination of the resistor R1 and Zener diode Z1, which, in turn, is connected across the DC output terminals 90 and 92. A second transistor Q2 having gate, drain and source terminals, is connected with its drain and source terminals connected between the gate terminal of the transistor Q1 and the negative DC output terminal 92. The gate terminal of the transistor Q2 is connected at the junction of the serial combination of the resistor R2 and the Zener diode Z2, which, in turn, is connected between the positive and negative DC terminals 90 and 92, respectively. The resistor R3 and the diode D6 are connected in parallel with the resistor R2. The capacitor C1 is connected in parallel with the Zener diode Z2.

On power up, the DC control voltage is applied across the serial combination of the resistor R1 and Zener diode Z1, forcing the Zener diode Z1 into conduction which, in turn, turns on the transistor Q1 to short out the holding winding 64. This allows the full starting current to flow through the starting winding 62 to close the separable main contacts 22.

During power up, the capacitor C1 is charged through the resistor R2. When the threshold voltage of the transistor Q2 is reached, the transistor Q2 turns on which, in turn, turns off the transistor Q1. This, in turn, unshorts the holding winding 64 to reduce the electrical current through the starting winding 62. The Zener diode Z2 may be connected in parallel across the capacitor C1 to limit the voltage thereacross.

Figure 2:
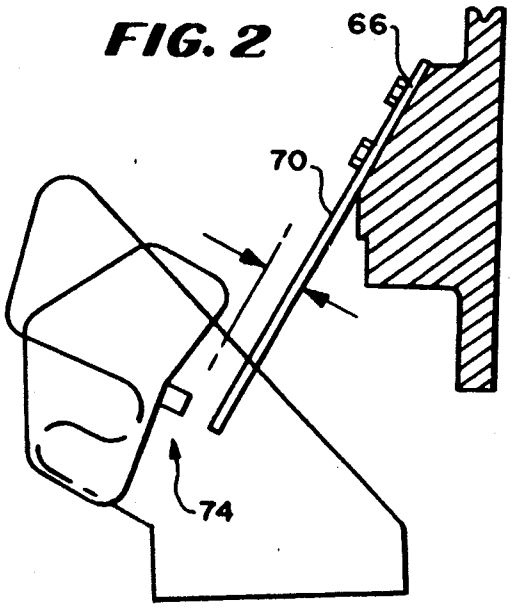
FIG. 2 is a partial sectional view of the opposite side of the contactor shown in FIG. 1, illustrating a limit switch for sensing the position of the armature.

A relatively fast discharge path is provided for the capacitor C1 by way of the resistor R3, the diode D6 and the low impedance starting and holding windings 62 and 64. While power is being applied to the control circuit, the diode D6 is reversed biased by the positive DC output terminal 90 of the bridge rectifier 84 and the gate voltage of the transistor Q2. The diode D6 is preferably a low leakage diode to minimize leakage from the capacitor C1 while power is applied to the circuit. However, once power is removed, the diode D6 becomes forward biased to allow the capacitor C1 to quickly discharge through the resistor R3, the diode D6 and the starting and holding windings 62 and 64. Since the impedance of the starting and holding windings 62 and 64 is relatively small relative to the resistance of the resistor R3, the time to discharge the capacitor C1 is essentially equivalent to the time constant of the combination of the resistor R3 and the capacitor C1. This quick discharge of the capacitor C1 allows the circuit to mimic an external limit switch, such as the limit switch 74 (FIG. 2).

In lieu of the external limit switch 74, the circuit in FIG. 4 utilizes a time delay, determined by the R2,C1 time constant to simulate when the main contacts 22 have closed. This time constant is based on the time determined by testing, for example, for the main contacts 22 to close under various voltage conditions. More specifically, at rated voltage across the starting winding 62 (e.g., 120 volts DC), the main contacts 22 will close after a predetermined time period, for example, 30 milliseconds after power is applied. However, at less than rated voltage, for example, 80 volts, the time period may be two to three times that value, for example, 60 to 90 milliseconds. In general, the lower the voltage applied to the starting winding 62, the longer it will take for the separable main contacts 22 to close. Accordingly, to assure proper operation of the circuit under all anticipated operating conditions, the R2,C1 time constant should be selected to be slightly longer than the time to close the separable main contacts 22 when the minimum pick up voltage is applied to the starting winding 62.

Another alternate embodiment of the present invention is illustrated in FIG. 5. This embodiment includes the bridge rectifier 84 which includes the diodes D1, D2, D3, D4, defining AC input terminals 86 and 88 and DC output terminals 90 and 92. The circuit also includes a surge protector device 94, diodes D5, D6, D7, D8, D9, resistors R1, R2, R3, R4, R5, R6, capacitors C1, C2, transistors Q1, Q2, Q3 and Zener diodes Z1, Z2, Z3 and Z4.

The diodes D1, D2, D3 and D4 are connected as a full wave rectifier defining AC input terminals 86 and 88 and DC output terminals 90 and 92. The starting winding 62 is serially connected to the holding winding 64. The serial combination is connected across the DC output terminals 90 and 92. The diode D5 is connected as flyback diode across the starting winding 62. The transistor Q1 is connected with its drain and source terminals connected in parallel across the holding winding 64. The gate terminal of the transistor Q1 is connected to the positive DC terminal 90 by way of the resistors R2 and R6. The Zener diode Z4 is connected at the junction of the resistors R2 and R6 and the negative DC output terminal 92. The transistor Q2 is connected with its drain and source terminals connected between the negative DC output terminal 92 and the junction of the resistors R2 and R6. The gate terminal of the transistor Q2 is connected to the negative DC output terminal 92 by way of the capacitor C1. A Zener diode Z2 is connected in parallel with the capacitor C1. The Zener diode Z3, the resistor R1 and the diode D9 are connected in series. The series combination is coupled between the gate terminal of the transistor Q2 and the positive DC output terminal 90. The diode D7 is serially connected to the resistor R4; the series combination connected between the positive DC output terminal 90 and the negative DC output terminal 92 by way of the capacitor C2. A resistor R3 is connected between the capacitor C2 and the capacitor C1. A diode D8 is connected in parallel with the resistor R3. A bipolar transistor Q3 having a base, collector and emitter terminal is connected with its collector terminal connected to the positive DC output terminal 90 and its emitter terminal connected to the capacitor C2 by way of the diode D6. The base terminal of the transistor Q3 is connected to the positive DC output terminal by way of the resistor R5. The base terminal is connected to the negative DC output terminal by way of the Zener diode Z1.

The transistor Q3, the resistor R5, the Zener diode Z1 and the capacitor C2 form a DC power supply. The breakdown voltage of the Zener diode Z1 may be selected at 15 volts DC, for example, to provide a 15 volt DC power supply. The resistor R5 is selected to limit the current to the Zener diode Z1 to prevent damage.

On power up, the voltage across the DC output terminals 90 and 92 is applied across the series combination of the resistor R5 and Z1. This causes the Zener diode D1 to go into conduction which, in turn, switches on the transistor Q3 and charges the capacitor C2 by way of the diode D6. At the same time, the capacitor C1 is charged by the power supply by way of the charging resistor R3. During this condition, the diode D8, in parallel with the resistor R3, is reverse biased.

In order to accommodate fluctuations in the control power voltage, derived from the source of electrical power 80 which, as discussed previously, can affect the time required to close the separable main contacts 22, a voltage dependent timing circuit is provided which consists of the Zener diodes Z2 and Z3, the resistor R1 and the diode D9. This timing circuit gives the characteristic of timing faster at higher voltages and slower at lower voltages to accommodate differences in closing times attendant with variations in the control power voltage. More specifically, when the control power voltage is less than the breakdown voltage of the Zener diode Z3, indicating a relatively low operating voltage and, consequently, a relatively slow closing time, the capacitor C1 is charged solely by way of the capacitor C3 and resistor R3. However, if the voltage across the DC output terminals 90 and 92 is greater than the breakdown voltage of the Zener diode Z3, the capacitor C1 will also be charged by way of the Zener diode Z3, resistor R1 and the diode D9. Since the charge transfer to a capacitor is related to the voltage applied to the capacitor, the charge transfer to the capacitor C1 will vary by the amount that the control power voltage at the DC output terminals 90 and 92 exceeds the breakdown voltage of the Zener diode Z3. Since the contactor 20 will close fastest at relatively higher voltages, the breakdown voltage of the Zener diode Z3 and the time constant of the capacitor C1 and the resistor R1 should be selected to be slightly larger than the expected closing time of the separable main contacts 22 when the maximum expected voltage is applied to the starting winding in a hot condition (e.g., increased starting winding resistance) 62. Additionally, the R3, C1 time constant should be selected to be slightly longer than the expected time required for the separable main contacts 22 to close under relatively lower operating voltage conditions, such as at the minimum pick up voltage for the starting winding 62.

Once the capacitor C1 is charged to the threshold level of the transistor Q2, the transistor Q2 turns on which, in turn, switches off the transistor Q1. This, in turn, unshorts the holding winding 64 and limits the electrical current through the starting winding 62. The flyback diode D5 provides a recirculation path for the current through the starting winding 62 as a result of the sudden decrease in electrical current therethrough.

When the control power is applied to the circuit, the diodes D7 and D8 are reverse biased while diode D9 is forward biased. However, when power is disconnected, the diodes D7 and D8 become forward biased and the diode D9 becomes reverse biased. This provides a quick discharge path for the capacitor C1 through the diode D8, resistor R4, diode D7 and the relatively low impedance coil windings 62 and 64. The quick discharge path allows the circuit to be reset for the next operation.

Many modifications and variations of the present invention are possible in light of the above teachings. Thus, it is to be understood that, within the scope of the appended claims, the invention may be practiced otherwise than as specifically described above.

What is claimed and desired to be secured by letters patent of the United States is:

1. A control circuit for an electrical device having a starting winding and a holding winding connected in serial combination for controlling an armature, comprising:

means for applying electrical power across the serial combination of said starting winding and said holding winding;

means for shorting said holding winding when electrical power is applied;

means for disabling said shorting means after a predetermined time period after said electrical power is applied, said disabling means including a timing circuit which includes a resistor R and capacitor C defining a RC time constant, said RC time constant representing a time which is substantially equivalent to said predetermined time period; and means for discharging said capacitor through said starting winding and said holding winding.

* * * * *